United States Patent [19]

Stemke

[11] Patent Number: 4,661,276

[45] Date of Patent: Apr. 28, 1987

[54] GREASE COMPOSITION

[75] Inventor: Jeffrey E. Stemke, Napa, Calif.

[73] Assignee: Chevron Research Company, San Francisco, Calif.

[21] Appl. No.: 868,839

[22] Filed: May 30, 1986

Related U.S. Application Data

[63] Continuation-in-part of Ser. No. 717,402, Mar. 29, 1985, abandoned, which is a continuation of Ser. No. 393,903, Jun. 30, 1982, abandoned.

[51] Int. Cl.[4] ..... C10M 119/24

[52] U.S. Cl. ..... 252/51.5 A

[58] Field of Search ..... 252/51.5 A

[56] References Cited

U.S. PATENT DOCUMENTS

| | | | |
|---|---|---|---|
| 3,634,493 | 1/1972 | Piccolini | 252/51.5 A |
| 3,868,330 | 2/1975 | Meinhardt et al. | 252/51.5 A |
| 3,947,367 | 3/1976 | Foelsch et al. | 252/51.5 A |

*Primary Examiner*—Jacqueline V. Howard

*Attorney, Agent, or Firm*—S. R. LaPaglia; R. C. Gaffney; J. J. DeYoung

[57] ABSTRACT

Disclosed is a polyurea-thickened grease containing a polymeric material which improves the low shear stability of the grease.

9 Claims, No Drawings

GREASE COMPOSITION

CROSS REFERENCE TO RELATED APPLICATIONS

This application is a continuation-in-part of Ser. No. 717,402, filed Mar. 29, 1985, now abandoned which is a continuation of Ser. No. 393,903, filed June 30, 1982, now abandoned the entire disclosures of which are incorporated herein by reference.

BACKGROUND OF THE INVENTION

The requirement that grease compositions provide adequate lubrication at high temperature for extended periods of time has become increasingly important. For this reason, grease compositions containing a variety of organic thickening agents, such as those containing multiple uriedo or urea functional groups, have been developed. For example, U.S. Pat. Nos. 3,242,210, 3,243,372, and 3,401,027 disclose polyurea grease thickeners obtained by reacting a three-component reactant mixture comprising a monoamine, a diamine and a diisocyanate, or a monoisocyanate, a diisocyanate and a diamine. As a general rule, the reaction product is comprised of a mixture of urea-containing species of varying chain length and urea content. However, by careful control of reaction variables such as, e.g., the relative quantities of reactants employed, the reaction temperature and the rate and order of reactant mixing, a product may normally be obtained which predominates in one polyurea species. The polyurea reaction is preferably carried out in situ in the grease carrier, and the reaction product may be utilized directly as a grease thickener.

While greases thickened with polyurea thickeners are in many respects superior to older lubricants in severe service application, especially with regard to maintenance of grease consistency at high temperatures, such greases suffer several disadvantages which limit their usefulness under practical service conditions. For example, while polyurea-thickened greases show excellent retention of mechanical properties at high temperature (70° C. or above) and high shear, they tend to soften considerably when subjected to low shear. In fact, the tendency to soften under low shear can be so great that the grease can, when subject to mechanical working under these conditions, undergo a change in penetration grade, e.g., from a No. 2 NLGI penetration grade to a No. 1 NLGI penetration grade. This change in penetration grade under low shear is particularly troublesome since it may occur under practical use conditions when the grease is transferred from the original shipping container or is otherwise stirred or handled. Consequently, normal handling of the grease in making it available to the ultimate consumer may change its consistency to such extent that it is no longer the desired penetration grade for the intended application. While it is true that the change in consistency is reversible in that the softened grease can be subjected to high shear to return the grease to its original consistency, this reversal often requires that the softened grease be shipped back to the formulator for reprocessing.

DESCRIPTION OF THE PRIOR ART

Disclosed in U.S. Pat. Nos. 4,104,177 and 4,111,822 are polyurea-thickened greases containing certain acylated alkylene polyamines of the formula:

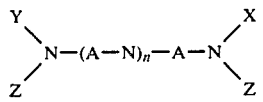

wherein A is alkylene of 2 to 4 carbon atoms and n is an integer of from 0 to 3; X is H or Z; Y is selected from H, alkyl containing 12 to 22 carbon atoms; and Z is an acyl group. These additives are disclosed as providing improved ambient temperature mechanical stability and improved rust protection in polyurea-thickened greases. As is readily apparent to those skilled in the art, the above polyamine is not a polymer because of its low molecular weight and limited number of monomeric units (5).

SUMMARY OF THE INVENTION

A grease composition comprising a major amount of a lubricating oil base vehicle, a polyurea gellant in an amount sufficient to thicken the base vehicle to a grease consistency, and a minor amount of a polymer having a pKa value greater than 5.0.

DETAILED DESCRIPTION OF THE INVENTION

The grease composition of the present invention comprises the combination of at least three components: (1) a lubricating oil base vehicle, (2) a polyurea gellant, and (3) a polymer. Other additives can also be present but only the above three are absolutely essential.

The lubricating oil base vehicle and the polyurea gellant are well known in the art. Any lubricating oil base vehicle commonly used in greases can be used. Generally, the base vehicle will comprise 50 to 99 weight percent of the final grease composition. The base vehicles are most commonly petroleum oils or synthetic base oils.

The polyurea gellant component for use in the present combination is also well known in the grease art and may be prepared by conventional means. For example, U.S. Pat. No. 3,242,210 describes the preparation of polyurea-thickened greases suitable for use in the combination of the present invention, and its disclosure is incorporated herein by reference. The polyurea is used in an amount sufficient to thicken the base vehicle to grease consistency. When used as a gellant, the polyureas are normally present in an amount of at least about 0.5 weight percent and more usually from about 1 to 25 or more weight percent.

Well-known polyurea-thickened greases contain polyureas of the following formula:

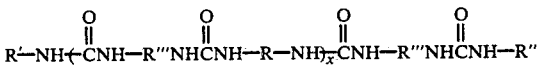

wherein x is an integer of from 1 to 3, R and R''' may be the same or different and are hydrocarbylene of from 2 to 30 carbon atoms (hydrocarbylene is a divalent organic radical composed solely of carbon and hydrogen which may be aliphatic, alicyclic or aromatic or combinations thereof, e.g., alkaryl, aralkyl, etc., having its two free valences on different carbon atoms); R' and R'' may be the same or different and are hydrocarbyl of from 1 to 30 carbon atoms (hydrocarbyl is a monovalent organic radical composed solely of carbon and hydrogen which may be aliphatic, aromatic, or alicyclic or combinations thereof, e.g., aralkyl, alkaryl, etc.).

The polyureas of the above formula are readily prepared by mixing diisocyanates and diamines with monoisocyanates or monoamines in the proper proportions to form the desired polyurea. The greases thickened with the polyureas are useful at temperatures from about −100° F. to 500° F. and remain unctuous after long use, not becoming hard or brittle. The grease compositions thus formed are extremely resistant to emulsification in water.

The preferred greases are thickened by compositions of the following formula:

$$R^aNH\left(\overset{O}{\overset{\|}{C}}NHR^bNH\overset{O}{\overset{\|}{C}}NHR^cNH\right)_x\overset{O}{\overset{\|}{C}}NHR^bNH\overset{O}{\overset{\|}{C}}NHR^d$$

wherein x is an integer of from 1 to 3, preferably, 1; $R^a$ and $R^d$ are the same or different and are hydrocarbyl of from 5 to 28 carbon atoms, preferably of from 6 to 25 carbon atoms and $R^b$ and $R^c$ may be the same or different and will be hydrocarbylene of from 2 to 26 carbon atoms, more usually of from 2 to 18 carbon atoms. It is further preferred that in the tetraureas, the sum of the carbon atoms of $R^a$ and $R^d$ is in the range of 10 to 30 and the sum of the carbon atoms of $R^b$ and $R^c$ is in the range of 12 to 40.

The monoamine or monoisocyanate used in the formation of the polyurea will form the terminal end group. As already indicated, these terminal end groups will be of from 1 to 30 carbon atoms, but are preferably of from 5 to 28 carbon atoms and more desirably of from 6 to 25 carbon atoms. As already indicated, the substituent on the nitrogen is a hydrocarbon radical which may be aliphatic, aromatic or alicyclic, may be aliphatically saturated or unsaturated, or may be combinations of the various types of hydrocarbon radicals.

The third essential component in the grease of the present invention is a polymer (different than the polyurea gellant) having a pKa value greater than 5.0.

As used in the present invention, the term "polymer" refers to a macromolecule composed of an indefinite number of monomers as distinguished from an "oligomer" which is a molecule consisting of only a few monomer units, for example, dimer, trimer, tetramer, etc. For purposes of clarity in the present invention, the term "oligomer" is defined herein as molecules containing less than 6 monomer units and "polymer" as those containing 6 or more monomer units. Generally, the polymers useful in the present invention will have molecular weights greater than 1000 and preferably will be high molecular weight polymers having molecular weights from 2,000 to 5,000,000 or more and most preferably in the range of 5,000 to 100,000.

Addition of the polymer to the polyurea grease composition significantly improves the low shear stability of the composition. Why the polymers improve the low shear stability of polyurea-thickened greases is not completely understood. However, it is believed that hydrogen-bonding interactions between the polyurea molecules or fibers and the polymer may account for the improvement in the low shear stability. Thus, it is preferred to use polymers which are capable of hydrogen-bonding interactions with the polyurea molecules. Generally, these polymers will have a pKa value greater than 5.0 and preferably greater than 7.0. "pKa" refers to the negative logarithm of the acid dissociation constant which is well known in the art. Such polymers will be characterized by the presence of hydrogen-bond donor groups and/or hydrogen-bond acceptor groups. The most common of such polymers will generally contain oxygen, and/or nitrogen.

Representative classes of polymers for use in the present invention include the polyesters, polyamides, polyurethans, polyoxides, polysulfides, and polyamines.

Representative polyesters include: poly(ethylene terephthalate), poly(ethylene 4,4'-dibenzoate), poly(ethylene p-phenylenediacetate), poly(ethylene 4,4-isopropylidene-dibenzoate), poly(ethylene 4,4'-sulfonyldibenzoate), and polyvinylacetate.

Representative polyamides include: polyglycine, poly(β-alanine) or poly(3-aminopropionic acid), poly(4-aminobutyric acid), poly(5-aminovaleric acid), poly(6-aminocaproic acid), poly(7-aminoenanthic acid), poly(8-aminocaprylic acid), poly(9-aminopelargonic acid), poly(10-aminocapric acid), poly(11-aminoundecanoic acid), and poly(12-aminolauric acid).

Representative polyurethans include: poly(trimethylene ethylene-urethan).

Representative polyoxides include: polyformaldehyde, polyacetaldehyde, poly(ethylene oxide), poly(propylene oxide), and poly(trimethylene oxide).

Representative polysulfides include: poly(ethylene trimethylene sulfide), and polyethylenesulfide.

Representative polyamines include: poly(ethylene trimethylene amine), and polyvinylamine.

Other representative polymers for use in the present invention include polyvinyl alcohol, ethylene/vinyl acetate copolymers, polyvinyl pyrollidone, and polyacrylamide. Particularly preferred are the ethylene/vinyl acetate copolymers.

A minor but effective amount of the polymer is used to improve the low shear stability of the polyurea-thickened grease. Generally, from 0.1 to 20 weight percent or more of the final grease composition will comprise polymer and preferably 1 to 10 weight percent and most preferably 2 to 6 weight percent.

In order to demonstrate the invention more fully, reference is made to the following examples.

EXAMPLES

Examples 1–4

Polyurea Greases Made From Conventional Mineral Oil

A mixture of 85.76 grams (0.32 mole) of oleylamine (Armeen O), and 750.0 grams of oil were heated and stirred in a 3-liter stainless beaker to 75° C. 9.6 grams (0.16 mole) of ethylene diamine were then added and then a mixture of 55.68 grams (0.32 mole) toluene diisocyanate in 250 grams oil. The reaction mixture was then maintained at 75° C. for 30 minutes. 7.67 grams of $NaNO_2$ dissolved in a minimum of water were then added and the temperature of the reaction mixture was increased. At 120° C., 75 grams of polyvinyl pyrollidone and 3.1 grams of an aromatic-amine antioxidant were added and the heat increased to 150° C. The reaction mixture was then held at 150° C. for 30 minutes and then cooled to 100° C. 4.43 grams of a second conventional antioxidant were added and the mixture stirred at 100° C. for 15 minutes and allowed to cool to 70° C. 78.22 grams of conventional rust inhibitors were added and additional oil to bring the total oil added to 1200 grams. The cooled grease was milled 3 times through a 3-roll mill. The oil used was a conventional mineral oil (Chevron Neutral Oil 115).

The low shear stability of the grease was tested by measuring the percent softening using the ASTM Worked Penetration after 60 stokes (ASTM D-1403) and after 100,000 strokes (ASTM D-217). The greases were also tested using the Shell Roll Test (ASTM D-1831). The improvement in low shear stability is demonstrated by a lower percent softening. The results are shown in Table I. Also shown in Table I are the results of using other polymeric additives with the polyurea-thickened grease base described above, referred to as base grease "A" in Table I.

Examples 5–12

Polyurea Greases Made From Synthetic Hydrocarbon Base

A mixture of 1500 grams oleylamine (Adogen 172) and 10,750 grams of Mobil MCP-151 Synthetic Base Oil was heated and stirred to 75° C. When the mixture reached 75° C., 168 grams of ethylene diamine were added. When the temperature leveled off at 75° C., 836 grams of toluene diisocyanate in 3,750 grams of Mobil MCP-151 were added. An additional 500 grams of Mobil MCP-151 were then added and the mixture was stirred and kept at 75° C. for ½ hour. 1,425 grams of this mixture alone or with 75 grams of a polymer listed in Table I were later heated to 150° C. while stirring and held there for 30 minutes and then cooled to room temperature. The composition was milled through a 3-roll mill 3 times. The test results of the grease along with the various polymeric additives are shown in Table I. The base grease prepared above is referred to as base grease "B" in Table I.

4,104,177, was prepared. The additive was prepared according to the procedure specified in the patent from the reaction of Duomeen T and oleic acid at 190° C. The additive was tested for low shear stability at a concentration of 5 weight percent in the same polyurea-containing base grease as used in Example 5–12. The results are shown in Table I.

Examples 14–16

For the purpose of comparison of the present invention with U.S. Pat. Nos. 4,104,177 and 4,111,822, pour point depressant amounts of a methacrylate polymer were added to a polyurea thickened grease and the samples were tested for softening using the Shell Roll Test (ASTM D-1831). The base grease, referred to as base grease "C" in Table I, was prepared in the same manner as described in Examples 5–12.

Example 17

A shear stabilizing amount of a methacrylate type polymer was added to a test sample of the same polyurea thickened grease as in Examples 14 and 15 and then tested for softening using the Shell Roll Test (ASTM D-1831).

Examples 18 and 19

For the purpose of comparison of the present invention with U.S. Pat. No. 4,022,700, a grease was made by incorporating an aryldiazourea thickener (prepared as described in illustrative embodiment II of U.S. Pat. No. 4,022,700) into a 500 neutral mineral oil as described in Embodiment III. Samples were tested for softening using the Shell Roll Test (ASTM D-1831) with and without a methacrylate polymer viscosity index improver.

TABLE I

| Example | Grease Base | Grease Thickener | Polymer Additive | Weight % | P60 | Shell Roll % Softening | P100,000 % Softening |
|---|---|---|---|---|---|---|---|
| 1 | A | polyurea | None | — | 255 | 48.6 | 44.3 |
| 2 | A | " | Polyvinyl Pyrollidone | 4.78 | 295 | 22.7 | 15.9 |
| 3 | A | " | Polyacrylamide | 4.12 | 281 | 0.0 | 37.0 |
| 4 | A | " | Polyvinyl Alcohol | 3.90 | 280 | −2.5 | 28.9 |
| 5 | B | polyurea | None | — | 265 | 14.3 | 46.8 |
| 6 | B | " | Ethylene-vinylacetate copolymer[1] | 4.69 | 259 | 7.7 | 24.3 |
| 7 | B | " | Ethylene-vinylacetate copolymer[2] | 4.17 | 281 | 2.1 | 20.3 |
| 8 | B | " | Ethylene-vinylacetate copolymer[3] | 4.69 | 275 | 5.1 | 16.0 |
| 9 | B | " | $C_2$/Acrylic Acid 15% (pKa less than 5.0) | 4.55 | 295 | 45.4 | — |
| 10 | B | " | $C_2$/Acrylic Acid 5% (pKa less than 5.0) | 4.17 | 263 | 30.0 | — |
| 11 | B | " | Polyacrylamide | 4.69 | 265 | 7.5 | — |
| 12 | B | " | Polyvinyl Alcohol | 4.69 | 261 | 3.8 | — |
| 13 | B | " | Acylated Alkylene Amine | 5.00 | 279 | 12.1 | — |
| 14 | C | polyurea | none | — | 273 | 15.3[6] | 33.0 |
| 15 | C | " | methacrylate polymer[4] | 0.2 | 280 | 17.9 | 39.6 |
| 16 | C | " | methacrylate polymer[4] | 0.5 | 280 | 12.5 | 38.9 |
| 17 | C | " | methacrylate polymer[5] | 7.8 | 263 | 4.0 | — |
| 18 | C | arylazo | none | — | 270 | 20.6 | — |
| 19 | C | arylazo | methacrylate polymer[5] | 7.0 | 284 | 20.2 | — |

[1]Elvax 410, E. I. DuPont & Co.
[2]Elvax 460, E. I. DuPont & Co.
[3]Elvax 210, E. I. DuPont & Co.
[4]TC-10314, Texaco, Inc.
[5]Acryloid 951, Rohm & Haas
[6]Average of two tests Example 13

Prior Art

A polyurea grease containing an acylated alkylene amine, specifically additive A (Table I) in U.S. Pat. No.

As will be appreciated by those skilled in the art, the results of Table I demonstrate the effectiveness of the polymers of the present invention in improving the low shear stability of polyurea-containing greases.

Examples 9 and 10 demonstrate that a polymer having a pKa value less than 5.0 was ineffective in improving the low shear stability of the grease.

Example 13 further indicates that the polymers of the present invention are superior to the acylated alkylene amine of U.S. Pat. No. 4,104,177 in improving low shear stability of the grease.

Examples 15 and 16 compared to example 14 indicate that pour point depressant quantities of methacrylate polymers are ineffective in providing low shear stability to polyurea-thickened greases. On the other hand, Example 17 shows that the same type of polymer, at an effective concentration within the range of the present invention, have a very positive effect on improving the shear stability of polyurea thickened greases.

Example 18 as compared with example 19 indicates that the aryl di(azourea) thickened greases described in U.S. Pat. No. 4,022,700 when combined with a methacrylate polymer have essentially the same poor shear stability as the grease without the polymer modifier, even at the use concentrations of the present invention. This result shows that the aryl di(azourea) compounds do not give the same type of thickened grease as do the polyureas of this invention.

What is claimed is:

1. A grease composition comprising a major amount of a lubricating oil, a polyurea gellant in an amount sufficient to thicken the lubricating oil to grease consistency, and an effective amount in the range of 0.1 to 20 weight percent to improve the low shear stability of the polyurea thickened grease of a polymer having a pKa value greater than 5.0, said polyurea gellant having the following formula:

$$R'\text{—}NH\left(\overset{O}{\overset{\|}{C}}NH\text{—}R'''NH\overset{O}{\overset{\|}{C}}NH\text{—}R\text{—}NH\right)_x\overset{O}{\overset{\|}{C}}NH\text{—}R'''NH\overset{O}{\overset{\|}{C}}NH\text{—}R''$$

wherein x is a number having a value from 1 to 3, R′ and R″ are hydrocarbon radicals containing from 1 to 30 carbon atoms, R and R‴ are hydrocarbon radicals containing from 2 to 30 carbon atoms, wherein the ratio of carbon atoms to the number of urea groups is at least 6:1.

2. The grease composition of claim 1 wherein said polymer has a molecular weight greater than 1,000.

3. The grease composition of claim 2 wherein said polymer has a molecular weight in the range 2,000 to 5,000,000 and a pKa value greater than 7.0.

4. The grease composition of claim 3 wherein said polymer is an oxygen-containing polymer.

5. The grease composition of claim 3 wherein said polymer is selected from the group of polyesters, polyamides, polyurethans, polyamines, or polyoxides.

6. The grease composition of claim 3, wherein said polymer is selected from polyacrylamide, polyvinyl alcohol, ethylene-vinylacetate copolymers, or polyvinyl pyrollidone.

7. The grease composition of claim 2, 3 or 4 wherein said grease contains 1 to 10 weight percent of said polymer.

8. A grease composition comprising a major amount of a lubricating oil, a polyurea gellant in an amount sufficient to thicken the lubricating oil to grease consistency, and an effective amount in the range of 0.1 to 20 weight percent to improve the low shear stability of the polyurea thickened grease of a polymer having a pKa value greater than 5.0, said polyurea gellant having the following formula:

$$R^aNH\left(\overset{O}{\overset{\|}{C}}NHR^bNH\overset{O}{\overset{\|}{C}}NHR^cNH\right)_x\overset{O}{\overset{\|}{C}}NHR^bNH\overset{O}{\overset{\|}{C}}NHR^d$$

wherein x is a number having a value from 1 to 3; $R^a$ and $R^d$ are hydrocarbyl of from 5 to 28 carbon atoms, and $R^b$ and $R^c$ are hydrocarbylene of from 2 to 26 carbon atoms, wherein the ratio of carbon atoms to the number of urea groups is at least about 6:1.

9. The grease composition of claim 2 wherein said polymer is an ethylene-vinyl acetate copolymer.

* * * * *